US007097087B2

(12) United States Patent
Lammers et al.

(10) Patent No.: US 7,097,087 B2
(45) Date of Patent: Aug. 29, 2006

(54) POWERED STAPLER

(75) Inventors: Anthony J. Lammers, Gates Mills, OH (US); John R. Nottingham, Bratenahl, OH (US); John W. Spirk, Gates Mill, OH (US); Patrick W. Brown, Auburn, OH (US)

(73) Assignee: InnoDesk Business Tools, Inc., Beachwood, OH (US)

( * ) Notice: Subject to any disclaimer, the term of this patent is extended or adjusted under 35 U.S.C. 154(b) by 42 days.

(21) Appl. No.: 10/951,069

(22) Filed: Sep. 27, 2004

(65) Prior Publication Data

US 2005/0067456 A1 Mar. 31, 2005

Related U.S. Application Data

(60) Provisional application No. 60/506,113, filed on Sep. 26, 2003.

(51) Int. Cl.
*B25C 1/06* (2006.01)

(52) U.S. Cl. ..... 227/131; 227/7

(58) Field of Classification Search ..... 227/131, 227/5, 6, 7, 132, 155, 156
See application file for complete search history.

(56) References Cited

U.S. PATENT DOCUMENTS

| | | | | | |
|---|---|---|---|---|---|
| 3,282,489 | A | | 11/1966 | March | |
| 3,346,163 | A | | 10/1967 | Mangainaro | |
| 3,847,322 | A | | 11/1974 | Smith | |
| 4,300,282 | A | | 11/1981 | Bunyea et al. | |
| 4,421,264 | A | | 12/1983 | Arter et al. | |
| 4,726,505 | A | | 2/1988 | Okazaki | |
| 4,940,177 | A | | 7/1990 | Jimena | |
| 5,007,572 | A | | 4/1991 | Chung-Cheng | |
| 5,222,645 | A | | 6/1993 | Sueda | |
| 5,330,086 | A | * | 7/1994 | Shimomura et al. | 227/7 |
| 5,427,296 | A | * | 6/1995 | Chen | 227/7 |
| 5,474,222 | A | * | 12/1995 | Kanai et al. | 227/131 |
| 5,657,918 | A | * | 8/1997 | Shimomura et al. | 227/7 |
| 6,068,173 | A | | 5/2000 | Sueda | |
| 6,135,337 | A | | 10/2000 | Harris et al. | |
| 6,547,119 | B1 | | 4/2003 | Huang | |
| 6,755,337 | B1 | * | 6/2004 | Jairam et al. | 227/148 |
| 6,811,070 | B1 | * | 11/2004 | Takada | 227/120 |
| 2004/0016789 | A1 | | 1/2004 | Takada | |
| 2004/0079782 | A1 | | 4/2004 | Luo | |

FOREIGN PATENT DOCUMENTS

| | | |
|---|---|---|
| EP | 000242021 | 10/1987 |
| JP | 405084675 | 4/1993 |

OTHER PUBLICATIONS

Swingline, Inc., www.swingline.com, "Swingline Personal Electric Stapler," 1 p., Mar. 5, 2003, Acco Brands, Inc., Lincolnshire, Illinois.
Swingline, Inc., www.swingline.com, "Swingline Compact Electric Stapler," 1 p., Mar. 5, 2003, Acco Brands, Inc., Lincolnshire, Illinois.
Swingline, Inc., www.swingline.com, "Swingline Portable Electric Stapler," 1 p., Mar. 5, 2003, Acco Brands, Inc., Lincolnshire, Illinois.
Swingline, Inc., www.swingline.com, "Swingline Cordless Rechargeable Stapler," 1 p., Mar. 5, 2003, Acco Brands, Inc., Lincolnshire, Illinois.

* cited by examiner

*Primary Examiner*—Scott A. Smith
(74) *Attorney, Agent, or Firm*—DKW Law Group LLC

(57) ABSTRACT

A portable hand-held power stapler with an outer housing contoured to fit comfortably within the grip of a hand, said stapler having an improved actuation system comprising a manually operated power switch that will actuate the stapling mechanism when a paper-sensing arm positioned in a document insertion slot is brought into contact with the inserted edge of a document, thereby completing the electric circuit to the power source of the electric motor driving the stapling mechanism, said actuation system further having a manually actuated reverse switch to engage a reverse function of the stapling mechanism to clear a paper or staple jam.

17 Claims, 5 Drawing Sheets

POWERED STAPLER

RELATED APPLICATIONS

This application claims the benefit of U.S. Provisional Patent Application No. 60/506,113, entitled "Powered Stapler," filed Sep. 26, 2003.

BACKGROUND OF THE INVENTION

1. Field of the Invention

The present invention generally relates to electric staplers.

2. Description of the Prior Art

Electric staplers are known in the prior art. Such prior art staplers typically have an electric motor that is automatically activated by a switch when the operator inserts an item to be stapled into a slot in the stapler. Once the item is inserted, the motor is activated, and the stapler immediately punches a staple through the item. This mode of operation frequently results in the staple being placed in an unintended location, for instance, covering part of a word or number, since the operator has no opportunity to adjust the position of the item once the switch is closed by insertion of the item.

SUMMARY OF THE INVENTION

It is an objective of the present invention to provide a powered stapler that allows the operator to adjust the position of the item to be stapled before the stapler punches a staple through the item, thus permitting greater precision in the placement of the staples. This objective is realized by providing a powered stapler that requires two conditions to be met before the motor is activated. First, the item to be stapled must be inserted in the stapler. Second, a button on the stapler housing must be pressed to activate the stapler motor.

Accordingly, the invention provides a battery-powered stapler having a housing with a battery chamber in the rear end and a slot for receiving items to be stapled at the front end. The rear end of the housing forms a contoured handle. A stapling mechanism contained within said housing includes: a staple carriage containing a large number of U-shaped staple pins and having a staple punching outlet at the front; a staple biasing means within said staple carriage for urging said staple pins toward said staple punching outlet; a punching arm having a staple punching plate at the front end thereof, which punching arm is vertically moveable in order to punch out staple pins in the staple carriage through the staple punching outlet; and a matrix anvil for bending a staple pin punched out through said staple outlet. The housing also contains an arm drive means including an electric motor for driving said punching arm up and down and a control circuit for controlling the operation of said motor. Two switches must be actuated to cause the stapler to operate. First, a paper-sensing switch is actuated by insertion of an item to be stapled into the stapler. Then, once the operator determines that the item is properly positioned and ready to be stapled, the operator manually actuates the second switch, activating the motor and causing the stapler to staple the item.

DETAILED DESCRIPTION

Figure 1:
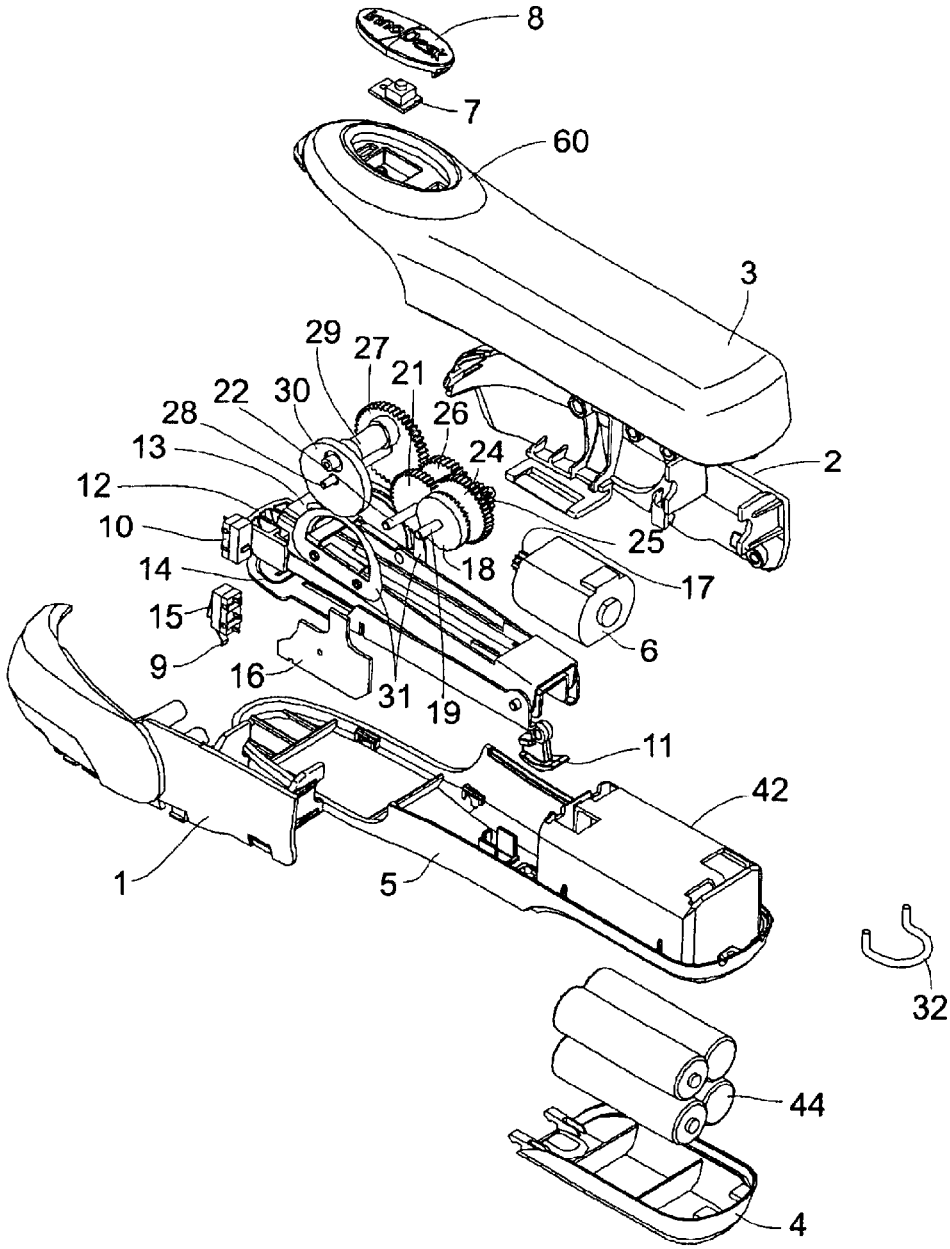
FIG. 1 is an exploded rear perspective view of a battery-powered stapler of the present invention.
Figure 2:
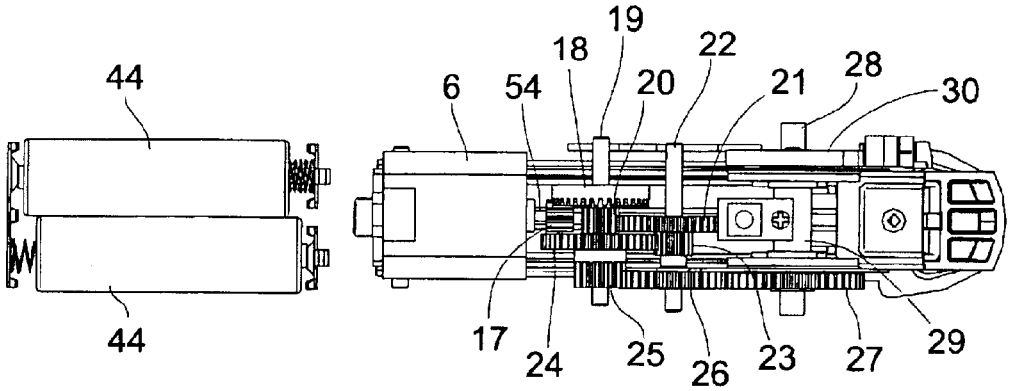
FIG. 2 is top plan view showing the internal components of a stapler of the present invention.
Figure 3:
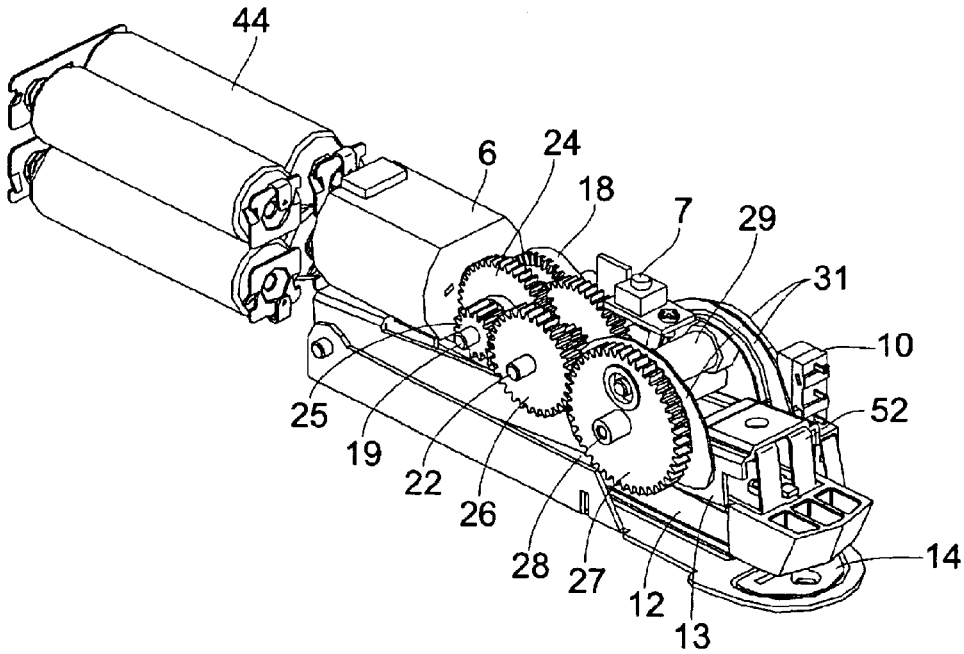
FIG. 3 is a front perspective view showing the internal components of a stapler of the present invention.
Figure 4:
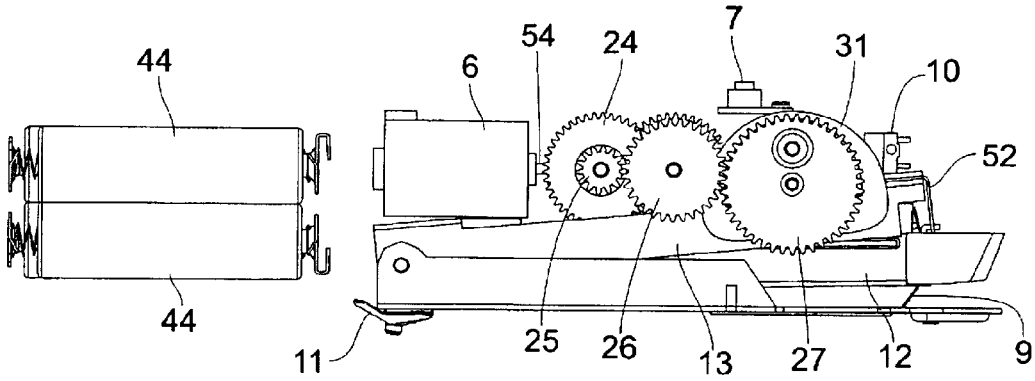
FIG. 4 is an elevational view showing the right side of the internal components of a stapler of the present invention.
Figure 5:
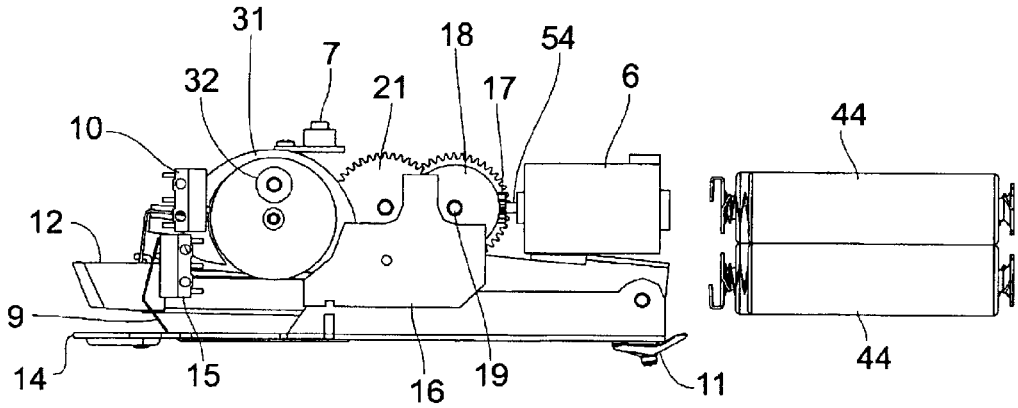
FIG. 5 is an elevational view showing the left side of the internal components of a stapler of the present invention.
Figure 6:
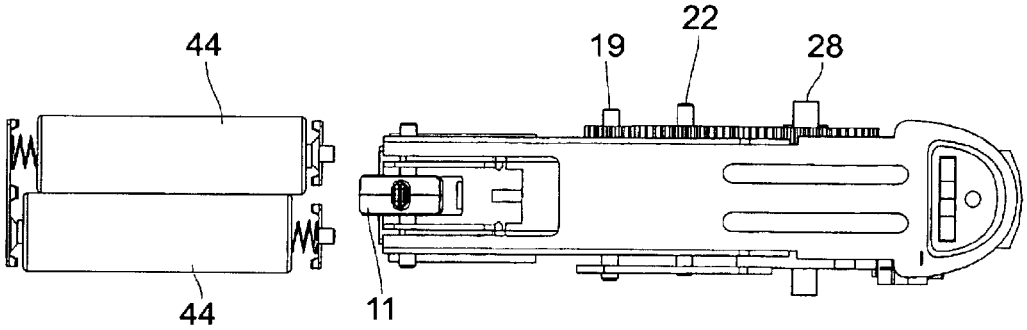
FIG. 6 is a bottom plan view showing the internal components of a stapler of the present invention.
Figure 7:
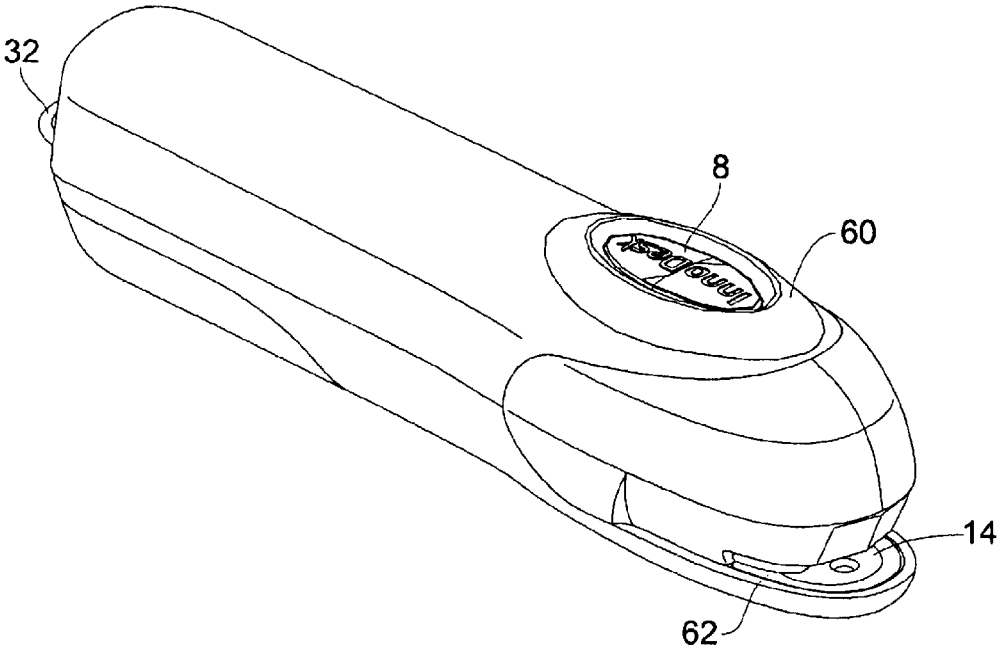
FIG. 7 is a front perspective view of a stapler of the present invention.

Referring to FIG. 1, there is shown an exploded view of a stapler of the present invention having a left housing piece 1, a right housing piece 2, a top housing piece 3, and a bottom housing piece 5, which fit together to form a housing to contain the internal components. Referring to FIG. 7, the front portion of the housing forms a slot 62 for receiving items to be stapled. In a preferred embodiment, the housing pieces are molded of ABS plastic. Referring again to FIG. 1, an optional hanging loop 32 protrudes from the rear end of the housing through adjoining surfaces of the top housing piece 3 and bottom housing piece 5 when the two pieces are brought together. The rear portion of the housing forms a contoured handle. In the preferred embodiment shown, the rear portion of bottom housing piece 5 includes an integrally molded battery compartment 42 to hold the batteries 44 that power motor 6. A removable battery door 4 snaps over the opening to battery compartment 42 to retain batteries 44 in said battery compartment 42. However, it is not an essential feature of the invention that batteries power the stapler. An alternative embodiment, not shown, may be powered by alternating current via a power cord plugged into an electrical outlet. Another alternative embodiment, not shown, may include batteries as well as an optional AC adapter to provide alternating current from an electrical outlet.

Referring to FIGS. 1, 2, 3, 4, and 5, contained within the housing is a stapling mechanism comprising a staple carriage 12 accommodating a large number of U-shaped staple pins, not shown, arranged in a sheet-like row in a groove slidable toward a staple punching outlet at the front end of the groove; a staple biasing means, not shown, within said staple carriage 12 for urging the staple pins in the staple carriage 12 toward the staple punching outlet; a punching arm 13, having a staple punching plate 52 at its forward end, vertically movably supported to punch out the staple pins in the staple carriage 12 one after another through the staple punching outlet; a pair of semicircular cam receivers 31 mounted on either side of the punching arm 13; and a matrix anvil 14 for bending a staple pin punched out through the staple outlet.

The up and down motion of the punching arm 13 by which staples are punched through the staple punching outlet is driven by an arm drive means comprising a reversible motor 6 and a series of gears, as follows. Referring to FIGS. 1, 2, 3, 4, and 5, motor 6 has a motor shaft 54 disposed toward the front end of the stapler. A pinion 17 fixedly mounted on said motor shaft 54 meshes with a crown gear 18 rotatably mounted on a first gear shaft 19. A first gear 20 formed integrally with the crown gear 18, meshes with a second gear 21 rotatably mounted on a second gear shaft 22. A third gear 23 formed integrally with the second gear 21 meshes with a fourth gear 24 rotatably mounted on the first gear shaft 19. A fifth gear 25 formed integrally with the fourth gear 24 meshes with a sixth gear 26 rotatably mounted on the second gear shaft 22. A cam mounting gear 27 rotatably mounted on a third gear shaft 28 meshes with the sixth gear 26. A cam mounting wheel 30 is rotatably mounted on the third gear shaft 28 near the end opposite the cam mounting gear 27, and a cam 29 is eccentrically mounted between the cam mounting gear 27 and the cam mounting wheel 30 by attachments to the cam mounting gear 27 and the cam mounting wheel 30. The gears are preferably manufactured of Nylon/Acetal. The gear shafts are successively located forward of the output shaft of the motor substantially at the same level as the latter and fitted and supported in bearings which are provided on the inner wall surfaces of the left housing piece 1 and right housing piece 2. The third gear shaft 28 passes through the semicircular openings formed by the cam receivers 31, so that the cam receivers 31 are positioned between the cam mounting gear 27 and the cam mounting wheel 30, with the cam 29 passing through the openings formed by the cam receivers 31.

In the preferred embodiment shown, the motor 6 is connected to the batteries 5 and controlled by a circuit board 16, a power switch 7, a paper-sensing switch 15, a stop switch 10 and a reverse switch 11. In the stapling operation, the operator inserts the item to be stapled in the space between staple carriage 12 and the matrix anvil 14. As the item to be stapled is inserted, it pushes against paper-sensing arm 9, causing paper-sensing arm 9 to press against and close paper sensing-switch 15. At this point, prior art electric staplers automatically staple the item, sometimes resulting in placement of the staple pin in a location that the operator did not intend. To avoid this problem, the present invention requires a second step. Once the operator is satisfied that the item to be stapled is properly positioned, the operator presses the power button 8. Pressing power button 8 closes power switch 7, which completes the electrical circuit and activates motor 6. Rotation of the pinion 17 on the motor shaft 54 causes the series of gears to rotate, resulting in a circular revolution of cam 29. Before commencement of the stapling operation, cam 29 is at the top position, as shown in FIG. 1. In the first half of its revolution, cam 29 moves downward, pressing against the top of punching arm 13 and causing the staple punch plate 52 to punch out a staple pin through the staple outlet. In the second half of the revolution, cam 29 moves upward, abutting against cam receivers 31, thereby lifting the latter upward to return the punching arm 13 to the initial resting position. At this point, a structure, not shown, on cam mounting wheel 30 presses against stop switch 10, causing motor 6 to stop.

In the preferred embodiment shown, power button 8 is located at the top and toward the front of the housing to make it easy for a user holding the stapler in one hand to press power button 8 with the thumb of the same hand. In the preferred embodiment, the housing also forms a raised collar 60 around power button 8 to help prevent accidental activation of the motor 6. However, alternative embodiments may have the power button located elsewhere and may not include a raised collar.

While the preferred embodiment requires actuation of both a paper-sensing switch and a manually actuated power switch to initiate the stapling action, it is possible within the scope of the invention to provide an alternative embodiment having no paper-sensing switch, so that the stapling operation will commence whenever the user presses the power button, regardless of whether a sheet of paper has been inserted in the stapler.

Figure 8:
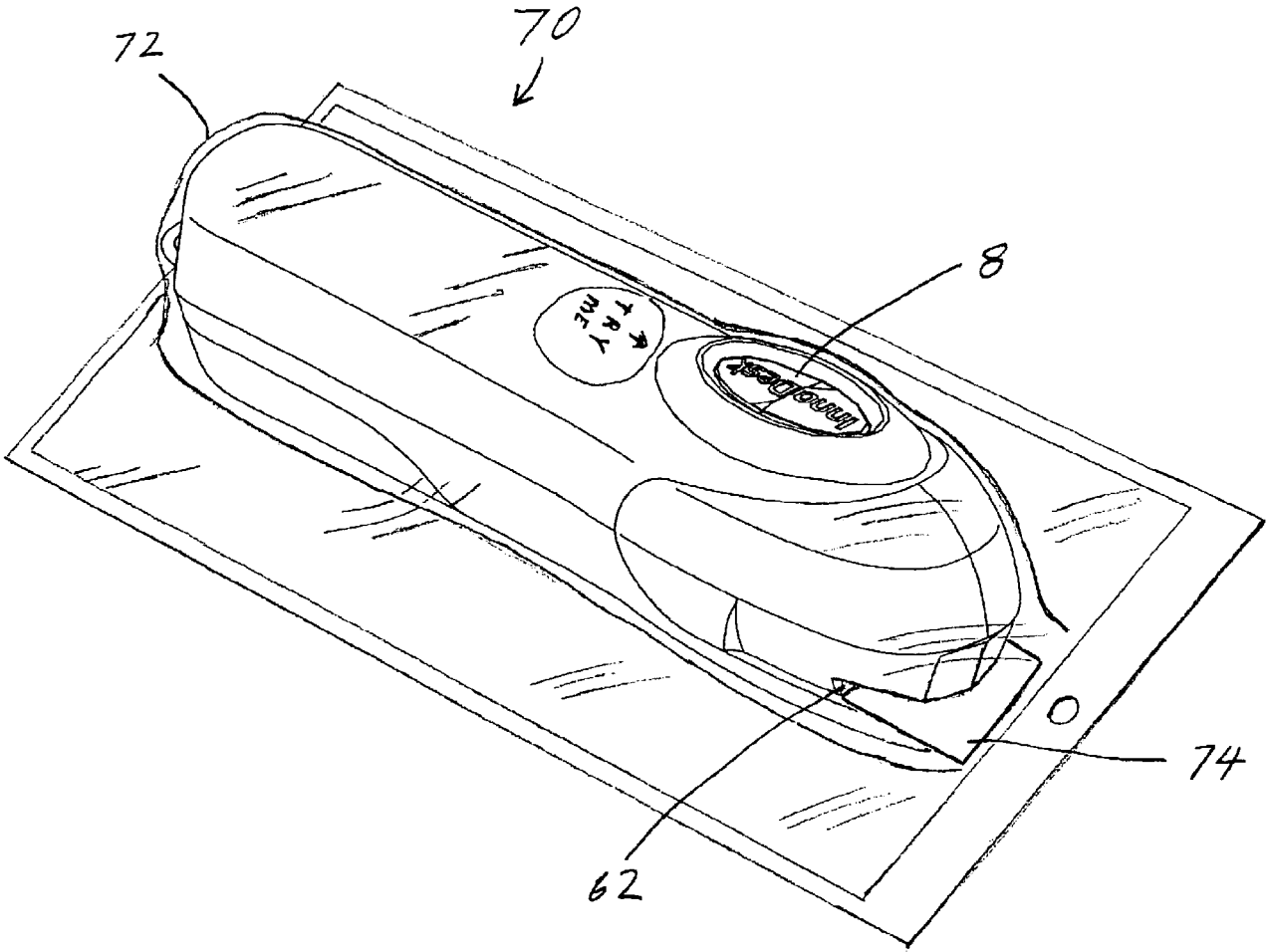
FIG. 8 is a perspective view showing a stapler of the present invention in a sealed package designed to permit operation of the stapler in the package.

Referring to FIGS. 1 and 8, in a preferred embodiment, the stapler, with batteries 44 installed but without any staple pins in the staple carriage 12, is packaged for sale in a sealed package 70 comprising a thin transparent barrier 72 of thermoformed plastic or the like. The barrier is pliable, so that a consumer can press power button 8 to actuate motor 6 in order to activate the stapling mechanism. The sealed package includes an insert piece 74 made of paper, paperboard, cardboard, or the like inserted into slot 62 so that paper-sensing arm 9 is continuously engaged in order to allow repeated activation of the stapling mechanism. Unlike prior art electric staplers that can perform the stapling operation only once each time a paper is inserted into the stapler, the control logic of circuit board 16 allows repeated activation of motor 6 without the need to remove and reinsert the piece of paper or the like in slot 62. This combination of features advantageously permits prospective purchasers to try the stapler in the package multiple times before purchasing it.

In the event that the punching arm 13 is stopped in the middle of its stroke due to jamming of a staple pin in the staple outlet or paper, the operator can actuate a reverse switch 11, which causes the motor 6 to operate in the reverse direction. By the reversed rotation of the motor 6, the punching arm 13 is moved upward, thereby allowing the jam to be cleared. In the preferred embodiment shown, reverse switch 11 is accessible through an opening in bottom housing piece 5, although it should be understood that reverse switch 11 may be located at any convenient position on the stapler. In a preferred embodiment, the reverse switch 11 is also mechanically linked to the staple carriage 12 so that if there is no staple jam, actuating the reverse switch 11 does not cause the motor 6 to operate, but releases the staple carriage 12 to allow the staple supply to be replenished.

In an alternative embodiment, not shown, the housing may include an optional compartment for holding an optional staple remover.

The descriptions set forth herein describe and explain the principle, preferred construction, and mode of operation of the invention, and illustrate and describe what we now consider to represent its best embodiments. However, it should be understood that various changes in the details, materials, and arrangements of parts or the method described herein may be made by those skilled in the art within the principle and scope of the invention.

We claim:

1. An electric stapler comprising:

a housing having an exterior, an interior, a front end, a rear end, a top, and a bottom, wherein said housing has a slot for receiving items to be stapled at said front end;

a stapling mechanism contained within said housing, said stapling mechanism comprising a staple carriage accommodating a supply of U-shaped staple pins arranged in a sheet-like row in a groove slidable toward a staple punching outlet at a front end of said groove, a staple biasing means within said staple carriage for urging said staple pins toward said staple punching outlet, a punching arm having a staple punching plate at a front end thereof, wherein said punching arm is vertically movably supported to punch out said staple pins in said staple carriage one after another through the staple punching outlet, a matrix anvil for bending a staple pin punched out through said staple outlet, an arm drive means including an electric motor for driving said punching arm up and down, a control circuit for controlling the operation of said motor, and means for supplying electricity to power said motor;

a manually operated power switch controlled by a power button on the exterior of said housing; and a manually actuated reverse switch that causes that motor to operate in the reverse direction in order to clear staple jams, wherein said manually operated power switch must be actuated in order to cause said motor to operate to drive a leading staple pin in said staple carriage into an item to be stapled.

2. The stapler of claim 1, further comprising a stop switch contained within the housing that automatically stops the motor when a single stapling operation has been completed.

3. The stapler of claim 1, wherein the reverse switch is accessible through the bottom of the housing.

4. The stapler of claim 1, wherein the reverse switch is mechanically linked to the staple carriage, such that actuation of said reverse switch when there is no staple jam releases the staple carriage in order to allow access to said staple carriage for replenishing the supply of staple pins.

5. The stapler of claim 1, further comprising a paper-sensing switch having a paper-sensing arm vertically disposed within the slot such that a paper inserted into said slot will press against said paper-sensing arm, actuating said paper-sensing switch, wherein said paper-sensing switch and said manually operated power switch must be actuated in order to cause the motor to operate to drive a leading staple pin in said staple carriage into an item to be stapled.

6. The stapler of claim 5, wherein the control circuit is designed to allow repeated performance of a stapling function as long as the paper-sensing switch is closed, without any need for opening and reclosing said paper-sensing switch between stapling operations.

7. The stapler of claim 6, wherein said stapler is enclosed in a sealed package having a means for momentarily operating said device while the device is inside the package, said package further comprising means for continuously maintaining the paper-sensing switch in a closed position in order to permit repeated activation of the motor.

8. The stapler of claim 1, wherein the means for providing electricity to the motor comprises a compartment in said housing for holding batteries.

9. The stapler of claim 8, wherein the means for providing electricity to the motor further comprises an electric power cord and adapter that can be plugged into a jack on the stapler in order to deliver alternating current from an electrical outlet to said motor.

10. The stapler of claim 1, wherein the means for providing electricity to the motor comprises an electric power cord that can be plugged into an electrical outlet in order to deliver alternating current to said motor.

11. The stapler of claim 1, wherein the housing further comprises a raised collar around the power button.

12. The stapler of claim 1, wherein the power button is disposed on the top and toward the front of the housing.

13. The stapler of claim 1, further comprising a loop for hanging said stapler.

14. The stapler of claim 1, wherein said stapler is enclosed in a sealed package having a means for momentarily operating said device while the device is inside the package.

15. An electric stapler comprising:

a housing having an exterior, an interior, a front end, a rear end, a top, and a bottom, wherein said housing has a slot for receiving items to be stapled at said front end;

a stapling mechanism contained within said housing, said stapling mechanism comprising a staple carriage accommodating a supply of U-shaped staple pins arranged in a sheet-like row in a groove slidable toward a staple punching outlet at a front end of said groove, a staple biasing means within said staple carriage for urging said staple pins toward said staple punching outlet, a punching arm having a staple punching plate at a front end thereof, wherein said punching arm is vertically movably supported to punch out said staple pins in said staple carriage one after another through the staple punching outlet, a matrix anvil for bending a staple pin punched out through said staple outlet, an arm drive means including an electric motor for driving said punching arm up and down, and a control circuit for controlling the operation of said motor;

a battery compartment in the rear of said housing for holding batteries to supply electricity to power said motor;

a manually operated power switch controlled by a power button on the exterior of said housing, said housing forming a raised collar surrounding said power button;

a paper-sensing switch having a paper-sensing arm vertically disposed within the slot such that a paper inserted into said slot will press against said paper-sensing arm, actuating said paper-sensing switch;

a stop switch contained within said housing that automatically stops said motor when a single stapling operation has been completed;

a manually actuated reverse switch that causes said motor to operate in the reverse direction in order to clear staple jams;

a loop for hanging said stapler;

characterized in that both said paper-sensing switch and said power switch must be actuated before the motor operates to drive a leading staple pin in said staple carriage into an item to be stapled.

16. An electric stapler comprising:

a housing having an exterior, an interior, a front end, a read end, a top, and a bottom, wherein said housing has a slot for receiving items to be stapled at said front end;

a stapling mechanism contained within said housing, said stapling mechanism comprising a staple carriage accommodating a supply of U-shaped staple pins arranged in a sheet-like row in a groove slidable toward a staple punching outlet at a front end of said groove, a staple biasing means within said staple carriage for urging said staple pins toward said staple punching outlet, a punching arm having a staple punching plate at a front end thereof, wherein said punching arm is vertically movably supported to punch out said staple pins in said staple carriage one after another through the staple punching outlet, a matrix anvil for bending a staple pin punched out through said staple outlet, an arm drive means including an electric motor for driving said punching arm up and down, and a control circuit for controlling the operation of said motor; and a manually operated power switc controlled by a power button on the exterior of said housing;

wherein said manually operated power switch must be actuated in order to cause said motor to operate to drive a leading staple pin in said staple carriage into an item to be stapled, and said stapler is enclosed in a sealed package having a means for momentarily operating said device while the device is inside the package.

17. An electric stapler comprising:

a housing having an exterior, an interior, a front end, a read end, a top, and a bottom, wherein said housing has a slot for receiving items to be stapled at said front end;

a stapling mechanism contained within said housing, said stapling mechanism comprising a staple carriage accommodating a supply of U-shaped staple pins arranged in a sheet-like row in a groove slidable toward a staple punching outlet at a front end of said groove, a staple biasing means within said staple carriage for urging said staple pins toward said staple punching outlet, a punching arm having a staple punching plate at a front end thereof, wherein said punching arm is vertically movably supported to punch out said staple pins in said staple carriage one after another through the staple punching outlet, a matrix anvil for bending a staple pin punched out through said staple outlet, an arm drive means including an electric motor for driving said punching arm up and down, and a control circuit for controlling the operation of said motor;

a manually operated power switch controlled by a power button on the exterior of said housing; and a paper-sensing switch having a paper-sensing arm vertically disposed within the slot such that a paper inserted into said slot will press against said paper-sensing arm, actuating said paper-sensing switch, wherein both said paper-sensing switch and said manually operated power switch must be actuated in order to cause the motor to operate to drive a leading staple pin in said staple carriage into an item to be stapled, the control circuit is designed to allow repreated performance of a stapling function as long as the paper-sensing switch is closed, without any need for opening and reclosing said paper-sensing switch between stapling operations, and said stapler is enclosed in a sealed package having a means fro momentarily operating said device while the device is inside the package, said package further comprising means for continuously maintaining the paper-sensing switch in a closed position in order to permit repeated activation of the motor.

* * * * *